US011774092B2

(12) United States Patent
Wu

(10) Patent No.: US 11,774,092 B2
(45) Date of Patent: Oct. 3, 2023

(54) BLOWTORCH HAVING CONTINUOUS-FLAME MODE

(71) Applicant: Pro-Iroda Industries, Inc., Taichung (TW)

(72) Inventor: Wei Cheng Wu, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 252 days.

(21) Appl. No.: 17/190,641

(22) Filed: Mar. 3, 2021

(65) Prior Publication Data

US 2022/0196236 A1 Jun. 23, 2022

(30) Foreign Application Priority Data

Dec. 17, 2020 (TW) ..... 109144721

(51) Int. Cl.
*F23D 14/46* (2006.01)
*F23D 14/38* (2006.01)

(52) U.S. Cl.
CPC ..... *F23D 14/465* (2013.01); *F23D 14/38* (2013.01); *F23D 2209/00* (2013.01)

(58) Field of Classification Search
CPC ..... F23D 14/38; F23D 14/465; F23D 2209/00
See application file for complete search history.

(56) References Cited

U.S. PATENT DOCUMENTS

| | | | | |
|---|---|---|---|---|
| 5,667,377 | A * | 9/1997 | Lin | F23D 14/38 431/255 |
| 6,196,833 | B1 | 3/2001 | Ho | |
| 6,343,928 | B1 | 2/2002 | Liang | |
| 10,731,854 | B2 | 8/2020 | Shen | |
| 2009/0026058 | A1 * | 1/2009 | Knuppel | H01H 3/20 200/522 |

FOREIGN PATENT DOCUMENTS

| | | | | |
|---|---|---|---|---|
| CN | 2504514 | Y | 8/2002 | |
| CN | 204127961 | U | 1/2015 | |
| CN | 108679641 | A | 10/2018 | |
| CN | 109556133 | A | 4/2019 | |
| CN | 210511657 | U | 5/2020 | |
| DE | 8908924 | U1 * | 10/1989 | |
| DE | 9320029 | U1 * | 6/1994 | |
| GB | 0777244 | A2 * | 6/1997 | |
| WO | WO-2008113546 | A2 * | 9/2008 | H01H 3/20 |

* cited by examiner

*Primary Examiner* — Jorge A Pereiro
*Assistant Examiner* — Logan P Jones

(57) ABSTRACT

A blowtorch includes a casing and a control unit. The control unit includes an activate button and a lock button. The lock button is switchable between a first lock position and an intermediate position, or between the intermediate position and a second lock position. The activate button is switchable between a standby position and an activation position when the lock button is in the intermediate position. The lock button contacts the activate button and restricts the activate button to hold in the activation position when the activate button is in the activation position and the lock button is in the first lock position or the second lock position.

6 Claims, 7 Drawing Sheets

BLOWTORCH HAVING CONTINUOUS-FLAME MODE

BACKGROUND OF THE INVENTION

The present invention relates to a blowtorch and, more particularly, to a blowtorch with a continuous-flame mode.

U.S. Pat. No. 10,731,854 B2 discloses a blowtorch, which includes a casing, an igniter received within the interior, and a safety control device for preventing the actuator being operated from an unactuated position to an actuated position movably coupled to the casing and connected to the igniter. The safety control device includes an actuator movably coupled to the casing, a release movably coupled to the actuator, a first biasing member positioned between the actuator and the release, a retainer movably coupled to the actuator, and a second biasing member positioned between the actuator and the retainer.

However, the above blowtorch is mainly suitable for right-handed users. The lock is arranged on the left side of the casing. The left-handed user can not switch the lock by the left hand thumb when the casing is held with the left hand.

In view of the above, a need exists for a blowtorch with improved ignition efficiency that mitigates and/or obviates the above drawbacks.

BRIEF SUMMARY OF THE INVENTION

An objective of the present invention is to provide a blowtorch with a continuous-flame mode. The blowtorch includes a casing and a control unit. The control unit includes an activate button and a lock button. An end of the activate button is disposed in the casing, and another end of the activate button is exposed out of the casing. The lock button has a first end, a second end opposite to the first end, and a middle portion between the first and second ends thereof. The first and second ends of the lock button are respectively exposed out of and disposed on two opposite sides of the casing. The middle portion of the lock button is disposed in the casing. The lock button is switchable relative to the casing between a first lock position and an intermediate position, or is switchable relative to the casing between the intermediate position and a second lock position. The activate button is switchable between a standby position and an activation position when the lock button is in the intermediate position. The lock button contacts the activate button and restricts the activate button to hold in the activation position when the activate button is in the activation position and the lock button is in the first lock position or the second lock position.

In an example, an outer periphery of the activate button is provided with an engaging flange. An outer periphery of the lock button is provided with a communication channel, a first engaging recess, and a second engaging recess. The first engaging recess and the second engaging recess are interconnected with an edge of the communication channel and are respectively disposed at two opposite sides of the communication channel. The engaging flange is movable in the communication channel when the activate button is switchable between the standby position and the activation position. The engaging flange is engaged in the first engaging recess when the activate button is in the activation position and the lock button is in the first lock position. The engaging flange is engaged in the second engaging recess when the activate button is in the activation position and the lock button is in the second lock position.

In an example, the engaging flange is disposed in the communication channel and restricts the lock button to hold in the intermediate position when the activate button is in the standby position.

In an example, the engaging flange is extended along a radial direction of a switching path of the activate button relative to the communication channel. The communication channel, the first engaging recess, and the second engaging recess are extended along a radial direction of a switching path of the lock button relative to the casing.

In an example, the lock button is provided with a first pressing portion, a second pressing portion, and an outward flange disposed between the first and second pressing portions. The first pressing portion and the second pressing portion are respectively disposed at the first and second ends the lock button. The first and second pressing portions each have a width in the radial direction of the switching path of the lock button being less than a width of the outward flange in the radial direction of the switching path of the lock button. The communication channel, the first engaging recess, and the second engaging recess are arranged in the outward flange. The first engaging recess is disposed on a first side of the communication channel adjacent to the first pressing portion. The second engaging recess is disposed on a second side of the communication channel adjacent to the second pressing portion.

In an example, the control unit further includes a first elastic member and a second elastic member. The first elastic member is sleeved on the first pressing portion. An end of the first elastic member abuts the outward flange, and another end of the first elastic member abuts an inner periphery of the casing. The first elastic member is configured to push the lock button towards the intermediate position. The second elastic member is sleeved on the second pressing portion. An end of the second elastic member abuts the outward flange, and another end of the second elastic member abuts the inner periphery of the casing. The second elastic member is configured to push the lock button towards the intermediate position.

In an example, an inner periphery of the first engaging recess is formed a first concave depression adjacent to the communication channel. An inner periphery of the second engaging recess is formed a second concave depression adjacent to the communication channel. The engaging flange abuts the first concave depression when the activate button is in the activation position and the lock button is in the first lock position. The engaging flange abuts the second concave depression when the activate button is in the activation position and the lock button is in the second lock position.

The present invention will become clearer in light of the following detailed description of illustrative embodiments of this invention described in connection with the drawings.

DETAILED DESCRIPTION OF THE INVENTION

Figure 1:
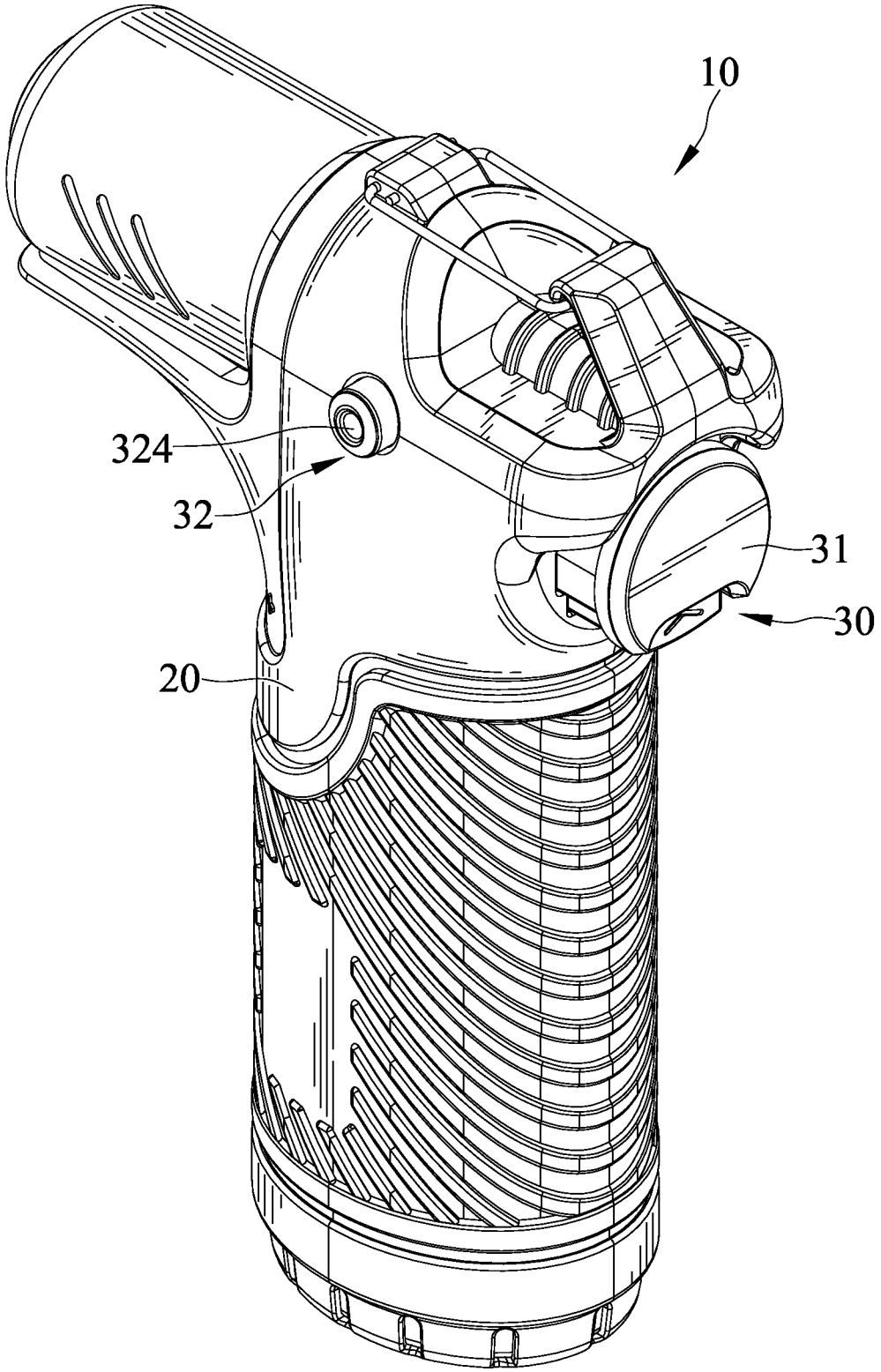
FIG. 1 is a perspective view of a blowtorch with blowtorch with a continuous-flame mode of an embodiment according to the present invention.
Figure 2:
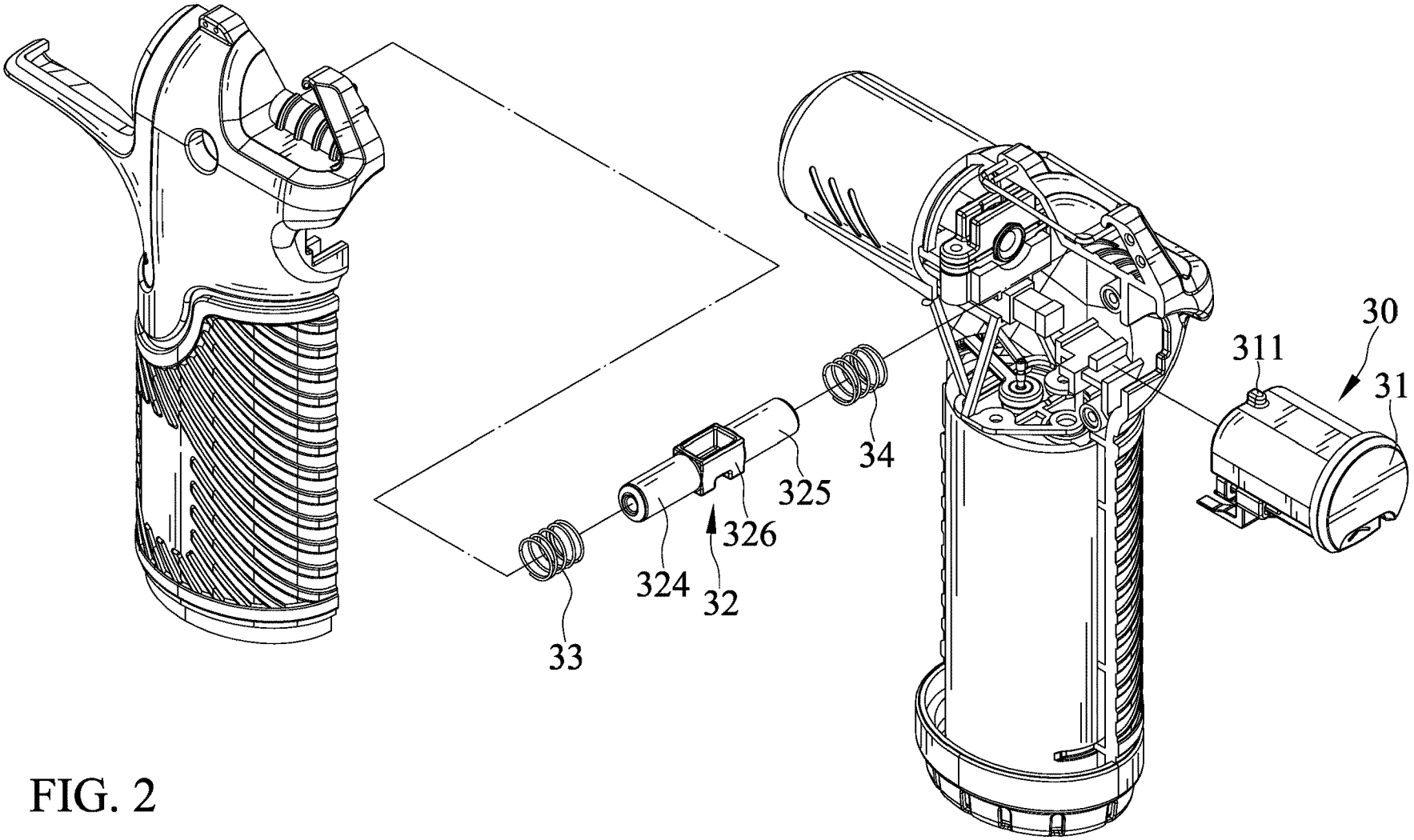
FIGS. 2 and 3 are exploded, perspective views of the blowtorch of FIG. 1.
Figure 3:
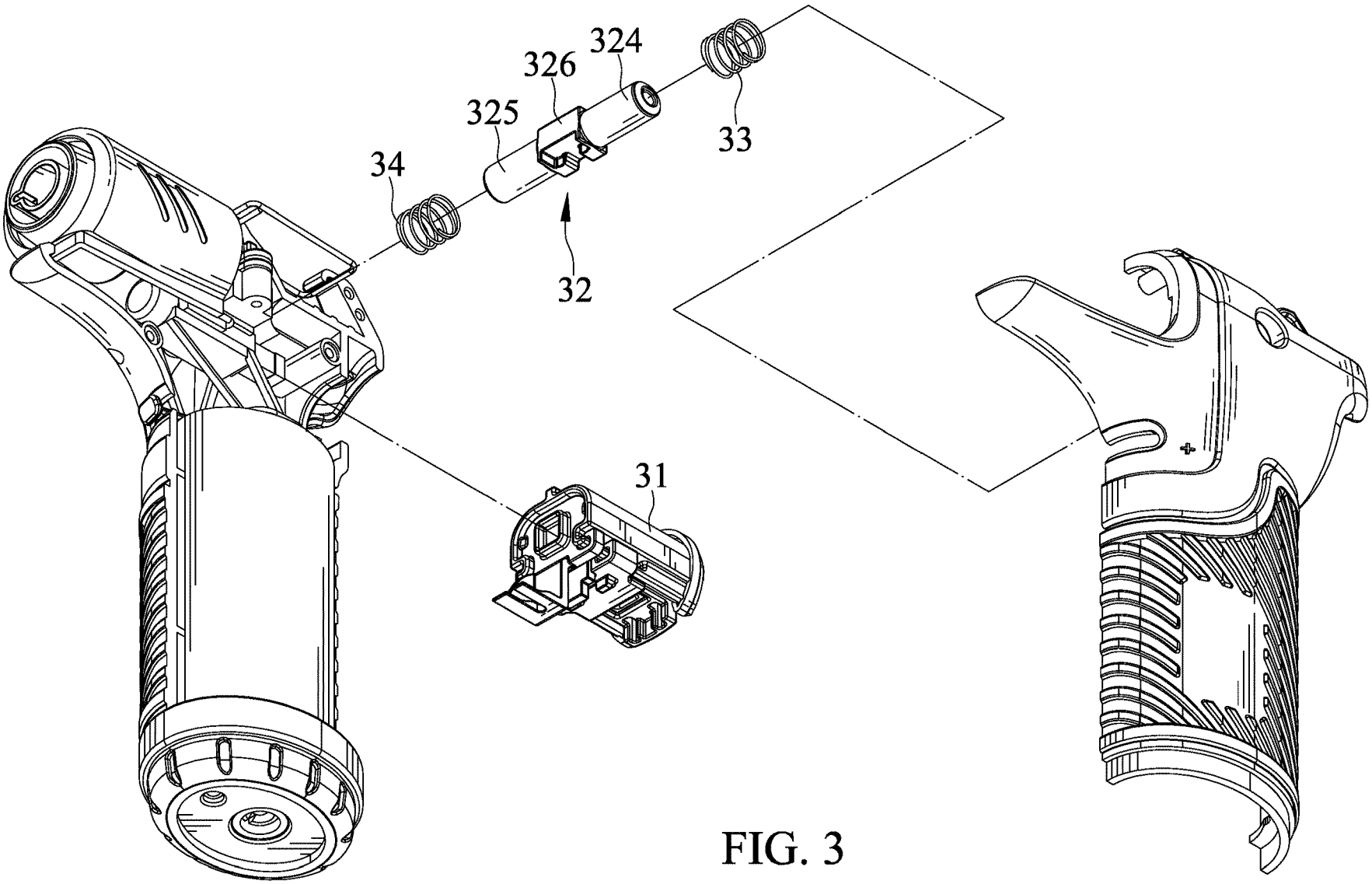
Figure 4:
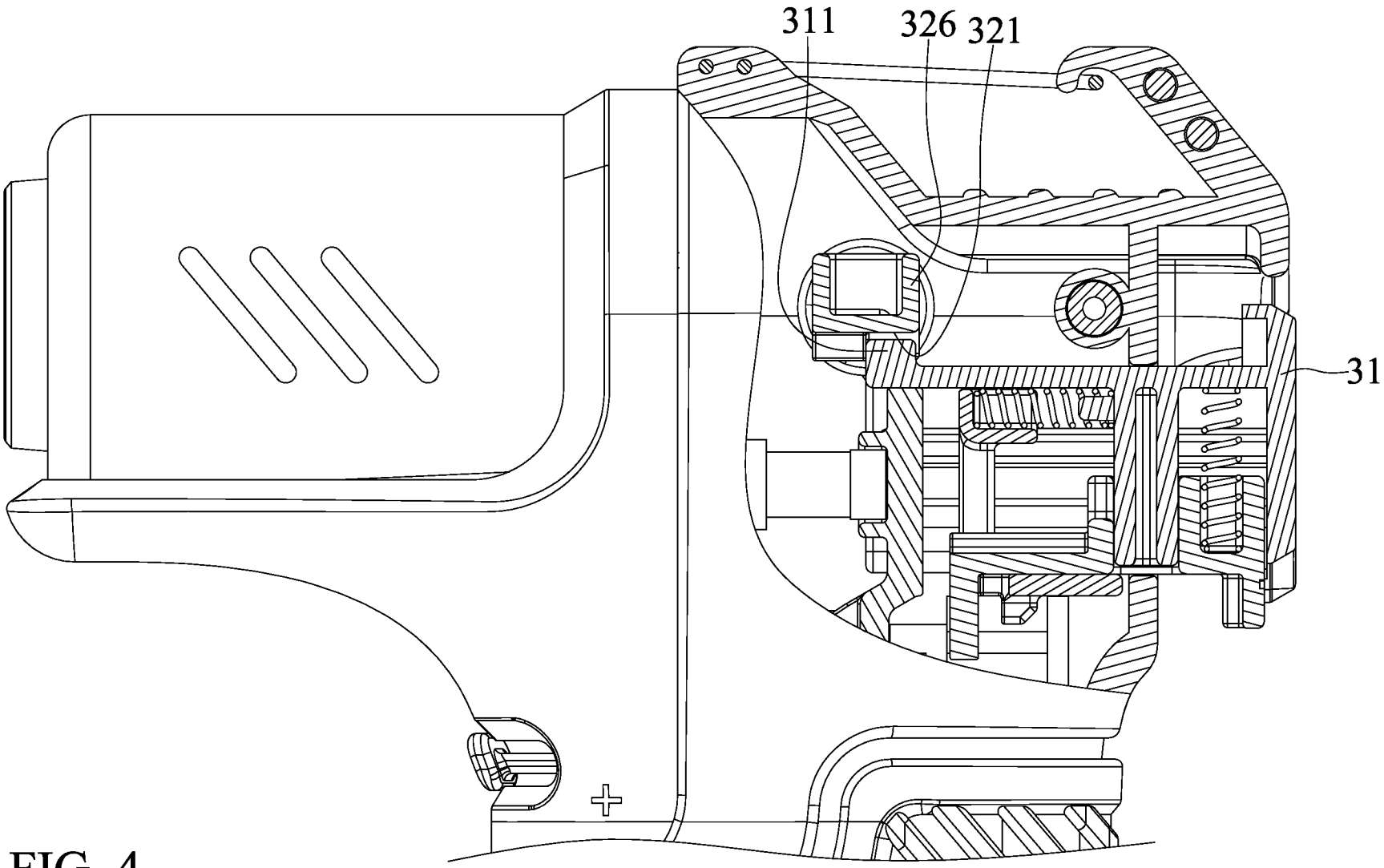
FIGS. 4 and 5 are cross-sectioned views of the blowtorch of FIG. 1.
Figure 5:
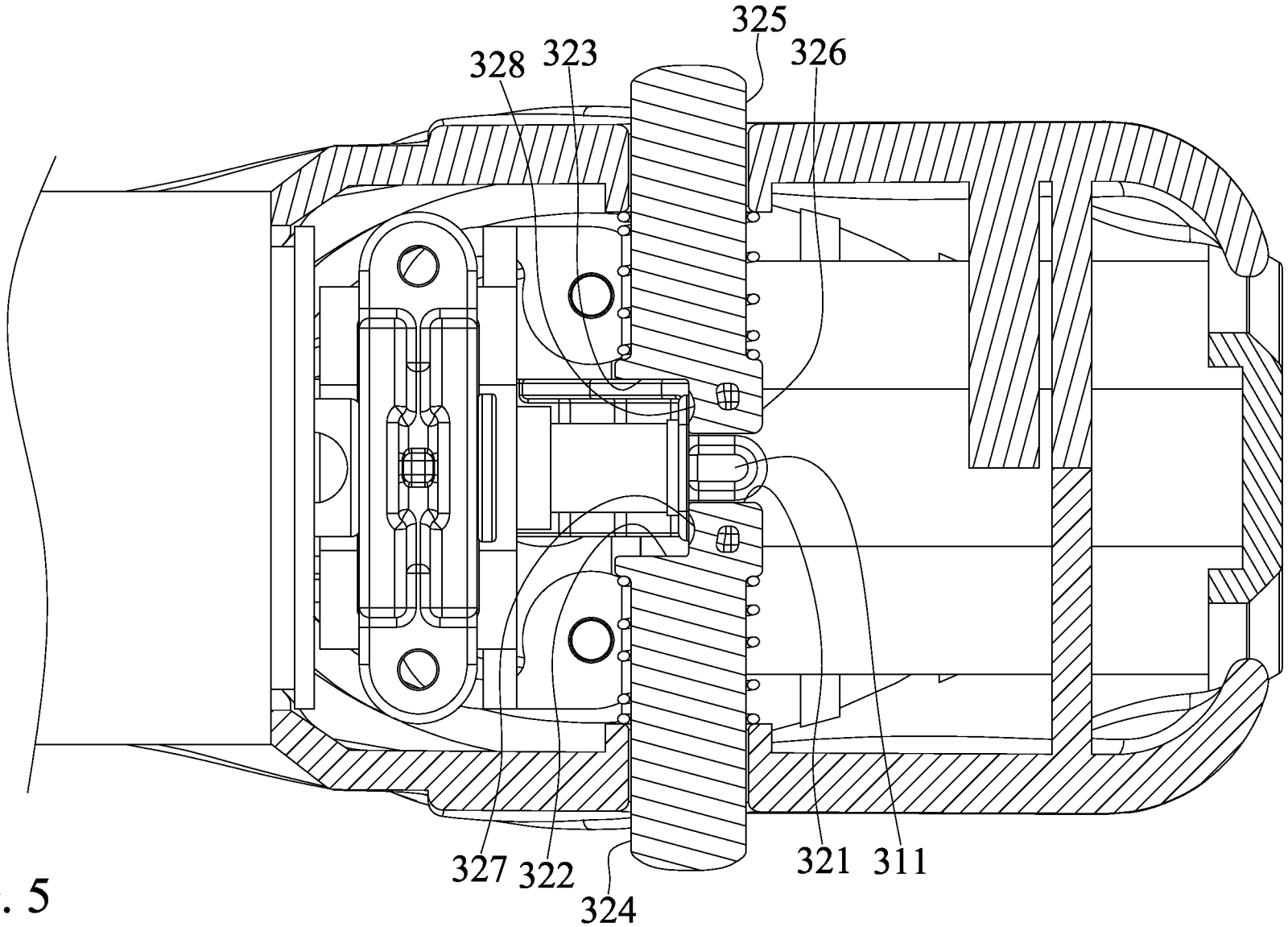
Figure 6:
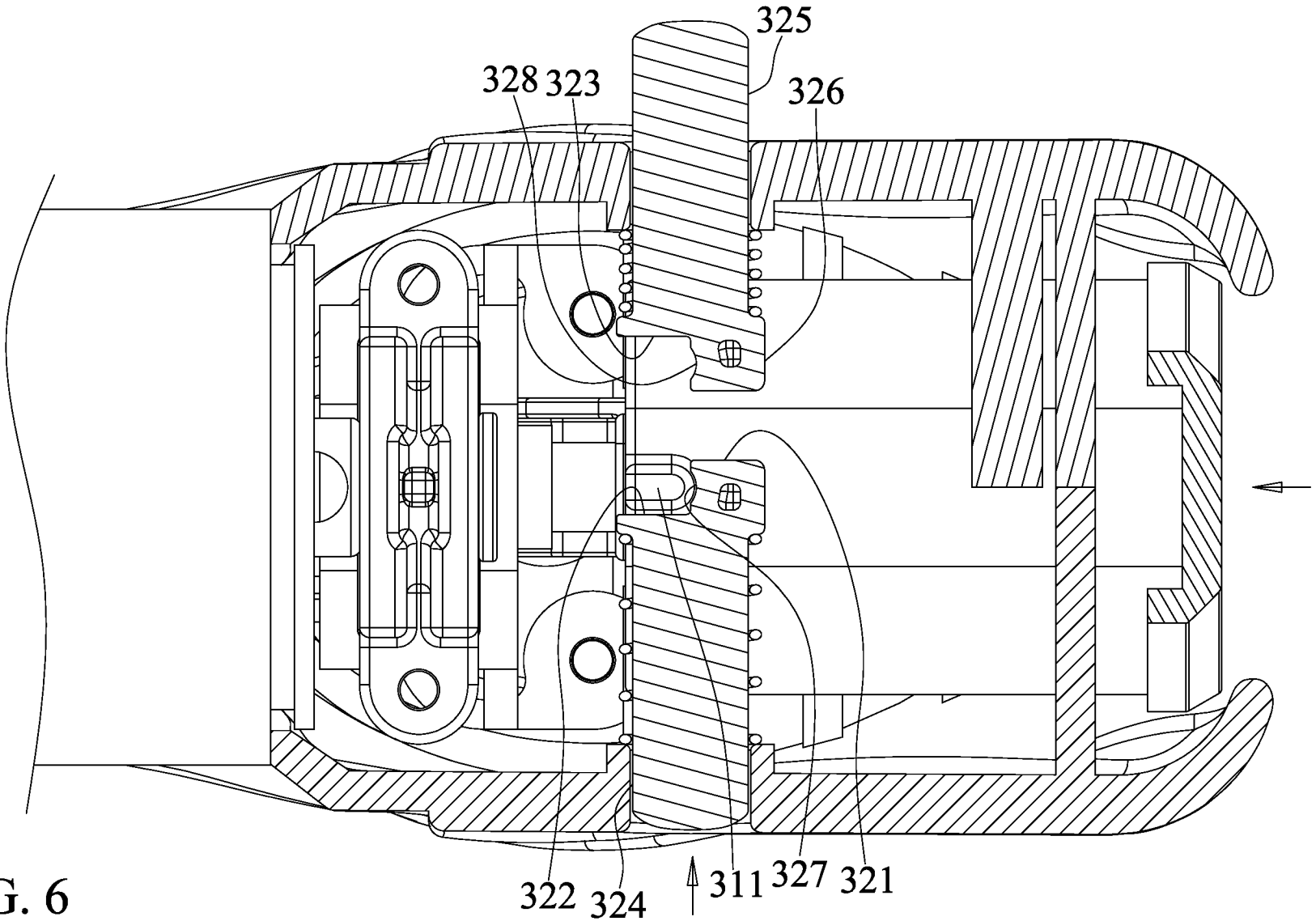
FIG. 6 is a cross-sectioned view of the blowtorch of FIG. 1 and illustrates a lock button is in a first lock position.
Figure 7:
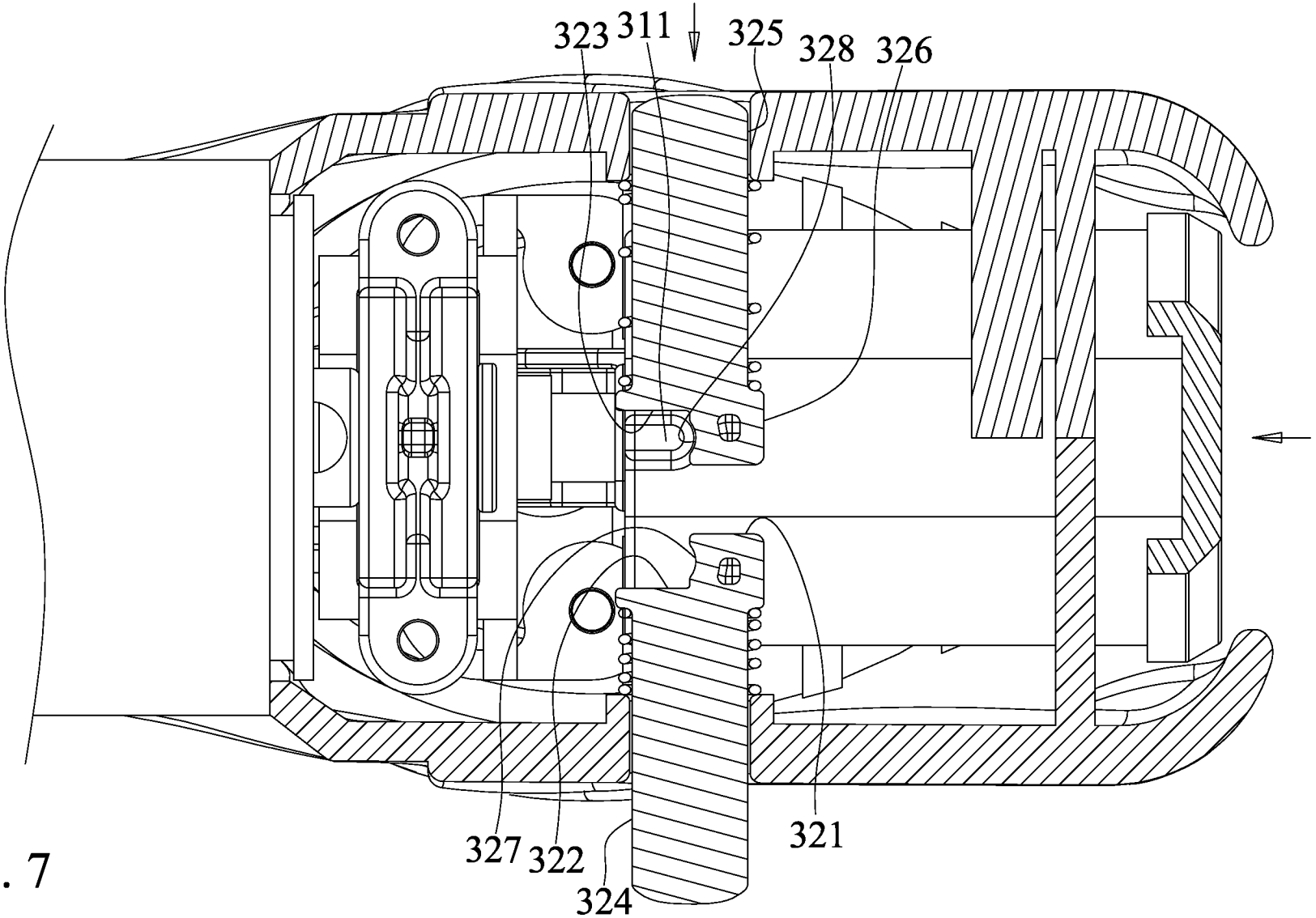
FIG. 7 is a cross-sectioned view of the blowtorch of FIG. 1 and illustrates a lock button is in a second lock position.

With reference to FIGS. 1-7, a blowtorch 10 with a continuous-flame mode of an embodiment according to the present invention comprises a casing 20 and a control unit 30. The control unit 30 includes an activate button 31 and a lock button 32. An end of the activate button 31 is disposed in the casing 20, and another end of the activate button 31 is exposed out of the casing 20. The lock button 32 has a first end, a second end opposite to the first end, and a middle portion between the first and second ends thereof. The first and second ends of the lock button 32 are respectively exposed out of and disposed on two opposite sides of the casing 20, and the middle portion of the lock button 32 is disposed in the casing 20. The lock button 32 is switchable relative to the casing 20 between a first lock position and an intermediate position, or is switchable relative to the casing 20 between the intermediate position and a second lock position. The activate button 31 is switchable between a standby position and an activation position when the lock button 32 is in the intermediate position. The lock button 32 contacts the activate button 31 and restricts the activate button 31 to hold in the activation position when the activate button 31 is in the activation position and the lock button 32 is in the first lock position or the second lock position.

Further, an outer periphery of the activate button 31 is provided with an engaging flange 311. An outer periphery of the lock button 32 is provided with a communication channel 321, a first engaging recess 322, and a second engaging recess 323. The first engaging recess 322 and the second engaging recess 323 are interconnected with an edge of the communication channel 321 and are respectively disposed at two opposite sides of the communication channel 321. The engaging flange 311 is movable in the communication channel 321 when the activate button 31 is switchable between the standby position and the activation position. The engaging flange 311 is engaged in the first engaging recess 322 when the activate button 31 is in the activation position and the lock button 32 is in the first lock position. The engaging flange 311 is engaged in the second engaging recess 323 when the activate button 31 is in the activation position and the lock button 32 is in the second lock position.

The engaging flange 311 is disposed in the communication channel 321 and restricts the lock button 32 to hold in the intermediate position when the activate button 31 is in the standby position.

Furthermore, the engaging flange 311 is extended along a radial direction of a switching path of the activate button 31 relative to the communication channel 321. The communication channel 321, the first engaging recess 322, and the second engaging recess 323 are extended along a radial direction of a switching path of the lock button 32 relative to the casing 20.

The lock button 32 is provided with a first pressing portion 324, a second pressing portion 325, and an outward flange 326 disposed between the first and second pressing portions 324 and 325. The first pressing portion 324 and the second pressing portion 325 are respectively disposed at the first and second ends the lock button 32. The first and second pressing portions 324 and 325 each have a width in the radial direction of the switching path of the lock button 32 being less than a width of the outward flange 326 in the radial direction of the switching path of the lock button 32. The communication channel 321, the first engaging recess 322, and the second engaging recess 323 are arranged in the outward flange 326. The first engaging recess 322 is disposed on a first side of the communication channel 321 adjacent to the first pressing portion 324, and the second engaging recess 323 is disposed on a second side of the communication channel 321 adjacent to the second pressing portion 325.

The control unit 30 further includes a first elastic member 33 and a second elastic member 34. The first elastic member 33 is sleeved on the first pressing portion 324. An end of the first elastic member 33 abuts the outward flange 326, and another end of the first elastic member 33 abuts an inner periphery of the casing 20. Thus, the first elastic member 33 is configured to push the lock button 32 towards the intermediate position. The second elastic member 34 is sleeved on the second pressing portion 325. An end of the second elastic member 34 abuts the outward flange 326, and another end of the second elastic member 34 abuts the inner periphery of the casing 20. Thus, the second elastic member 34 is configured to push the lock button 32 towards the intermediate position.

An inner periphery of the first engaging recess 322 is formed a first concave depression 327 adjacent to the communication channel 321. An inner periphery of the second engaging recess 323 is formed a second concave depression 328 adjacent to the communication channel 321. The engaging flange 311 abuts the first concave depression 327 when the activate button 31 is in the activation position and the lock button 32 is in the first lock position. The engaging flange 311 abuts the second concave depression 328 when the activate button 31 is in the activation position and the lock button 32 is in the second lock position.

The blowtorch 10 can provide a continuous-flame mode without constantly pressing the activate button 31. When the activate button 31 is switched to the activation position, the blowtorch 10 is in an activated state and starts to produce a flame, then the lock button 32 can be switched to the first lock position or the second lock position, so that the blowtorch 10 stays in the activated state to provide a continuous-flame mode, and the user does not need to press the activate button 31 constantly. In addition, the first pressing portion 324 and the second pressing portion 325 are respectively arranged on both sides of the casing 20, so that the blowtorch 10 can be suitable for left-handed or right-handed users.

Although specific embodiments have been illustrated and described, numerous modifications and variations are still possible without departing from the scope of the invention. The scope of the invention is limited by the accompanying claims.

The invention claimed is:

1. A blowtorch comprising:

a casing; and a control unit including an activate button and a lock button, wherein an end of the activate button is disposed in the casing, and another end of the activate button is exposed out of the casing, wherein the lock button has a first end, a second end opposite to the first end, and a middle portion between the first and second ends thereof, wherein the first and second ends of the lock button are respectively exposed out of and disposed on two opposite sides of the casing, wherein the middle portion of the lock button is disposed in the casing, wherein the lock button is further provided with a first pressing portion, a second pressing portion, and an outward flange disposed between the first and second pressing portions, wherein the first pressing portion and the second pressing portion are respectively disposed at the first and second ends the lock button, wherein the lock button is switchable relative to the casing between a first lock position and an intermediate position, and is switchable relative to the casing between the intermediate position and a second lock position, wherein the activate button is switchable between a standby position and an activation position when the lock button is in the intermediate position, wherein the lock button contacts the activate button and restricts the activate button to hold in the activation position when the activate button is in the activation position and the lock button is in the first lock position or the second lock position, and wherein the control unit further includes a first elastic member and a second elastic member, wherein the first elastic member is sleeved on the first pressing portion, wherein an end of the first elastic member abuts the outward flange, and another end of the first elastic member abuts an inner periphery of the casing, wherein the first elastic member is configured to push the lock button towards the intermediate position, wherein the second elastic member is sleeved on the second pressing portion, wherein an end of the second elastic member abuts the outward flange, and another end of the second elastic member abuts the inner periphery of the casing, and wherein the second elastic member is configured to push the lock button towards the intermediate position.

2. The blowtorch as claimed in claim 1, wherein an outer periphery of the activate button is provided with an engaging flange, wherein an outer periphery of the lock button is provided with a communication channel, a first engaging recess, and a second engaging recess, wherein the first engaging recess and the second engaging recess are interconnected with an edge of the communication channel and are respectively disposed at two opposite sides of the communication channel;

wherein the engaging flange is movable in the communication channel when the activate button is switchable between the standby position and the activation position;

wherein the engaging flange is engaged in the first engaging recess when the activate button is in the activation position and the lock button is in the first lock position;

wherein the engaging flange is engaged in the second engaging recess when the activate button is in the activation position and the lock button is in the second lock position.

3. The blowtorch as claimed in claim 2, wherein the engaging flange is disposed in the communication channel and restricts the lock button to hold in the intermediate position when the activate button is in the standby position.

4. The blowtorch as claimed in claim 3, wherein the engaging flange is extended along a radial direction of a switching path of the activate button relative to the communication channel, and wherein the communication channel, the first engaging recess, and the second engaging recess are extended along a radial direction of a switching path of the lock button relative to the casing.

5. The blowtorch as claimed in claim 4, wherein the first and second pressing portions each have a width in the radial direction of the switching path of the lock button being less than a width of the outward flange in the radial direction of the switching path of the lock button, wherein the communication channel, the first engaging recess, and the second engaging recess are arranged in the outward flange, wherein the first engaging recess is disposed on a first side of the communication channel adjacent to the first pressing portion, and wherein the second engaging recess is disposed on a second side of the communication channel adjacent to the second pressing portion.

6. The blowtorch as claimed in claim 1, wherein an inner periphery of the first engaging recess is formed a first concave depression adjacent to the communication channel, wherein an inner periphery of the second engaging recess is formed a second concave depression adjacent to the communication channel;

wherein the engaging flange abuts the first concave depression when the activate button is in the activation position and the lock button is in the first lock position;

wherein the engaging flange abuts the second concave depression when the activate button is in the activation position and the lock button is in the second lock position.

* * * * *